US008496050B2

(12) United States Patent
Arlandis

(10) Patent No.: US 8,496,050 B2
(45) **Date of Patent: *Jul. 30, 2013**

(54) ARRANGEMENT USED IN OIL FIELD WELLS FOR LIFTING HYDROCARBONS

(75) Inventor: Juan Carlos Marie Arlandis, Boulogne (AR)

(73) Assignee: Optimol Technologies, Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 12/986,571

(22) Filed: Jan. 7, 2011

(65) Prior Publication Data

US 2011/0094751 A1 Apr. 28, 2011

Related U.S. Application Data

(63) Continuation of application No. 12/335,588, filed on Dec. 16, 2008, now Pat. No. 7,866,381.

(30) Foreign Application Priority Data

Apr. 29, 2008 (AR) ..... P20080101804

(51) Int. Cl.
*E21B 43/00* (2006.01)

(52) U.S. Cl.
USPC ..... 166/68.5; 166/66; 166/72; 417/205

(58) Field of Classification Search
USPC ..... 166/68, 68.5, 72; 417/205, 489, 417/510
See application file for complete search history.

(56) References Cited

U.S. PATENT DOCUMENTS

| | | | |
|---|---|---|---|
| 654,706 | A | 7/1900 | Braymer |
| 4,750,865 | A | 6/1988 | Rivas et al. |
| 6,352,117 | B1 | 3/2002 | Strickland |
| 6,460,012 | B1 | 10/2002 | Welch |
| 6,464,012 | B1 | 10/2002 | Strickland |
| 6,497,561 | B2 | 12/2002 | Skillman |
| 6,854,518 | B1 | 2/2005 | Senyard et al. |
| 2002/0166662 | A1 | 11/2002 | Eggleston |

FOREIGN PATENT DOCUMENTS

| | | |
|---|---|---|
| WO | WO 02/081860 | 10/2002 |
| WO | WO 2007/084927 | 7/2007 |

*Primary Examiner* — Kenneth L Thompson
*Assistant Examiner* — Elizabeth Gitlin
(74) *Attorney, Agent, or Firm* — Defillo & Associates, Inc; Evelyn A Defillo

(57) ABSTRACT

Arrangement for the lifting of hydrocarbons in oil field wells, comprising a lifting assembly formed by a fluid collecting hose and a fluid suction tube within the well casing. The suction tube extends along the collecting hose, which has an open upper end, through which passes the upper section of the suction tube, which has an end attached to the pulling cable of the "collecting hose/suction tube" assembly.

9 Claims, 3 Drawing Sheets

ARRANGEMENT USED IN OIL FIELD WELLS FOR LIFTING HYDROCARBONS

FIELD OF THE INVENTION

The present invention is directed to an arrangement used in oil field wells for lifting hydrocarbons, and more particularly it is directed to a new arrangement of elements placed within production wells for safely lifting liquid or gaseous hydrocarbons, avoiding gas venting and thus allowing for an increase in productivity of the facility, among other important advantages.

BACKGROUND OF THE INVENTION

Lifting of hydrocarbons from oil fields involves introducing into the well a casing that extends down sufficiently to reach the hydrocarbon-containing strata, so that any oil, gas and water found therein may flow upwardly to the surface through the casing to be then separated, stored or channeled to its next destination. The oil, gas and water from the strata enter the casing and, because of their different densities, they segregate from each other so that water remains at the bottom of the casing, while oil floats over it and gas flows up through the casing.

Conventional oil lifting requires the use of pumping units disposed on the surface of the field ground and on the wellhead, which include, among other components used for fluid extraction, a pump lever, a suction rod and a pump placed downhole within the casing at the deepest possible production position. For operating the suction rod, its lower end is connected to the pump, while its upper end is connected to the pump lever disposed on the ground surface. By means of a mechanical arm lever, the pump lever drives the upwards and downwards reciprocating movement of the suction rod, thus performing the pumping work in the production well.

Another widely known type of pumping system consists in using a bailing system disposed on the ground surface adjacent to the production well, using a bailer mechanism disposed on the ground surface adjacent to the production well, comprising a bailer type (tube and hose) system, a pulling strip or cable which extends along an admission tube or arm, and a hoist mechanism. In this system for lifting hydrocarbons, the bailing system is operated by spooling and unspooling a pulling cable from a hoisting mechanism, to which one end of the wireline is attached, while the other end is attached to the upper end of the bailer-type mechanism placed within the well casing. During operation of the hoist mechanism by spooling and unspooling the wireline or cable, the latter makes a reciprocating movement and undergoes considerable stresses when it is spooled to lift the bailer or unspooled for lowering it to the oil-containing section of the well casing. When the bailer is submerged into the oil-containing section, it collects some oil and gets filled with it. Then, the bailer is lifted up to the surface and the oil is poured into a storage dam.

In these conventional systems for lifting hydrocarbons, fluid discharge from the hose that extends along the borehole is achieved by the action of gravity. These systems have disadvantages that must be overcome. In fact, during the lowering operation, the hose may stick to the tube due to the presence of viscous or paraffin hydrocarbons. These conditions may be affected by external temperatures and the tubes may be worn off by friction with the hose, which may cause ecological damage. In addition, the hose must have thicker walls in order to withstand the strain caused by the rollers over the curvature of the header when entering into the PVC tube. Furthermore, the hose diameter is limited by the header's entrance hole and the recovery capacity of the hose is limited by the length of the tubes, all of which leads to a reduction in productivity. Another disadvantage is that the hose detection system is external and has no protection. In addition, harsh environmental conditions (temperatures, wind, sunlight), the presence of animals, mishandling, etc. can damage the tube joints and cause leaks. The presence of gas pockets may damage PVC tubes and cause environmental damage. In addition, the horizontal tube where the fluid is discharged is made of plastic and can only withstand low gas pressure. Consequently, the gas cannot be transferred by its own pressure and requires permanent venting.

In order to solve the above mentioned drawbacks of conventional hydrocarbon-lifting facilities, the inventors have developed the arrangement of the present invention, which provides outstanding improvements over the prior art. In fact, the arrangement to be used in oilfield wells for lifting hydrocarbons is capable of capturing gas from the well and thus avoid venting, which increases productivity of the lifting equipment. One of the most important factors favoring productivity is the use of the gas pressure from inside the casing for draining the hose. The hose length may be made proportional to gas pressure at a ratio of 10 mt per 1 kg/sq. cm. of gas pressure, without modifying the length of the surface equipment. In addition, there will be less tubing on the surface and all the moving elements of the arrangement will remain within the casing, thus avoiding possible leaks of fluid at surface level and providing greater safety to the lifting process. It should also be underlined that equipment, mounting and operation costs are lower than those of conventional arrangements, no "pulling" is needed, it is easily maintained and consumes less power, among other advantages.

SUMMARY OF THE INVENTION

The present invention discloses an arrangement for the lifting of hydrocarbons, which is used in oil field wells, and comprises a lifting assembly having a fluid collecting hose and a fluid suction tube within the well casing. The suction tube extends along the collecting hose, which has an open upper end, through which passes the upper section of the suction tube having an end attached to the pulling cable of the "collecting hose/suction tube" assembly, and a lower end closed by means of a one-way check valve, through which the fluid flows into a space comprised between the hose and said tube. The upper section extending beyond the open upper end of the collecting hose has a laterally-conformed fluid discharge opening. When the "hose/suction tube" assembly is risen by action of the pulling cable to reach the end of its travel, said discharge hole is positioned within a sealed chamber in the wellhead, which is defined between a pair of sealing rings, and in this way the fluid is discharged with the assistance of the suction pump and/or the inner gas pressure from the casing.

DETAILED DESCRIPTION OF THE INVENTION

Figure 1A:
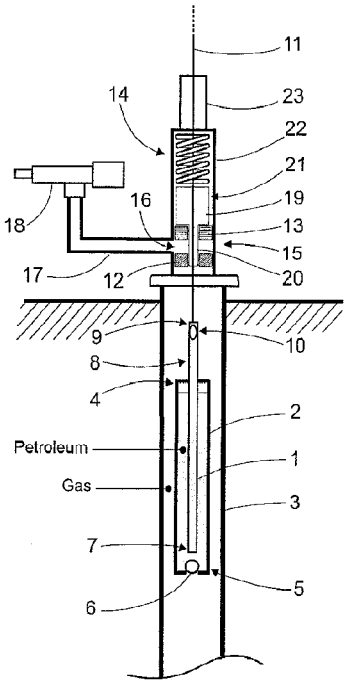
FIGS. 1A to 1C are schematic side elevation views showing the arrangement of the present invention positioned in a production well, which as a whole represents the lifting operation sequence for the fluid contained in the field.
Figure 1B:
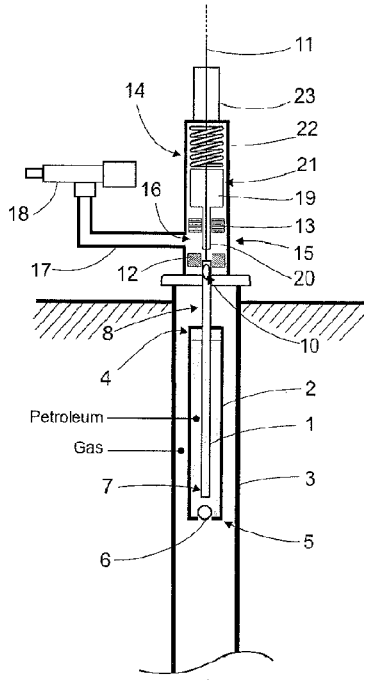
Figure 1C:
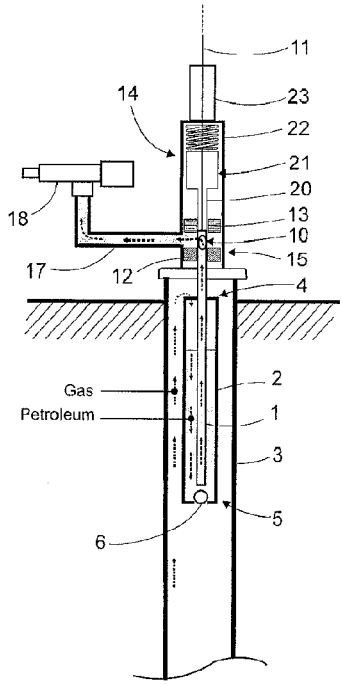

FIGS. 1A to 1C show that the hydrocarbon lifting arrangement placed within oil field wells of the invention comprises a lifting assembly formed by a suction tube 1 and a fluid collection hose 2, said assembly extending along the well casing 3. The hose 2 has an open upper end 4 and a lower end 5 closed by means of a one-way check valve 6 which opens into the hose 2 to let the fluid flow into it. In turn, the suction tube 1, which extends from the proximity of the check valve 6 and beyond the upper end 4 of the collecting hose 2, has a lower section 7 and an upper section 8 having a laterally positioned discharge opening 10 for the fluid being lifted. The upper section 8 of the suction tube 1 has a closed end 9, to which the pulling cable 11 is connected to cause the upwards and downwards movement of the lifting assembly defined by the suction tube 1 and the collecting hose 2.

The upper section 8 of the suction tube 1 is of a length such that, during operation of the facility, when the "tube-hose" assembly reaches the end of its upwards travel, the discharge hole 10 is positioned between a pair of sealing rings—a lower ring 12 and an upper ring 13—which are placed in the lower section 15 of the wellhead 14, a sealed chamber 16 being formed between said rings, where said chamber has a discharge opening coupled to a fluid outlet duct 17 connected to a suction pump 18.

The pulling cable 11, attached to the upper end 9 of the suction tube 1, passes through a cable guide bushing 19 and an actuating device that senses the sealed chamber 16. The bushing 19 is part of a member having a lower section 20, which defines the bushing itself and an upper section 21 having a larger diameter than said lower section 20 and defining a guide and an abutment on the sealing ring 13 within the upper section 22 of the header 14. As shown in the drawing, the bushing 19 passes through said pair of sealing rings 12 and 13 during the travel of the "tube-hose" assembly. In addition, the pulling cable 11 passes though a cable seal 23 positioned next to the upper section 22 of the wellhead 14.

As shown in the operation sequence represented in FIGS. 1A to 1C, when the "tube-hose" assembly is pulled up by the cable 11 until it reaches the end of the travel, the upper section 8 of the suction tube 1, and consequently the discharge opening 10, are positioned within the sealed chamber 16 defined between sealing rings 12 and 13. Immediately after the discharge opening 10 connects with the sealing chamber 16, the suction pump 18 begins to force the circulation of the fluid contained in the collecting hose 2 towards the outlet duct 17, passing through the discharge opening 10. Liquid flow, and consequently, oil production, is maintained during the parts of the cycle comprising ascending and descending of the "tube-hose" assembly, as long as the discharge opening 10 is in communication with the sealed chamber 10 and until the hose 2 is drained. In this part of the lifting process the check valve 6 remains closed.

During the descending travel of the "tube-hose" assembly, when the end 5 of hose 1 is submerged again into the fluid content of the well, the check valve 6 is opened by the pressure exerted thereon by the fluid, and consequently the hose 2 is filled again until the "tube-hose" assembly reaches the end of its descending travel, to be subsequently discharged in each "up/down" cycle of the "tube-hose" assembly. In gas-containing wells, the pressure exerted by the gas, depending on its intensity, will cause discharging of the hose 2, thus contributing to an increase in the fluid flow rate from the suction pump 18.

Figure 2:
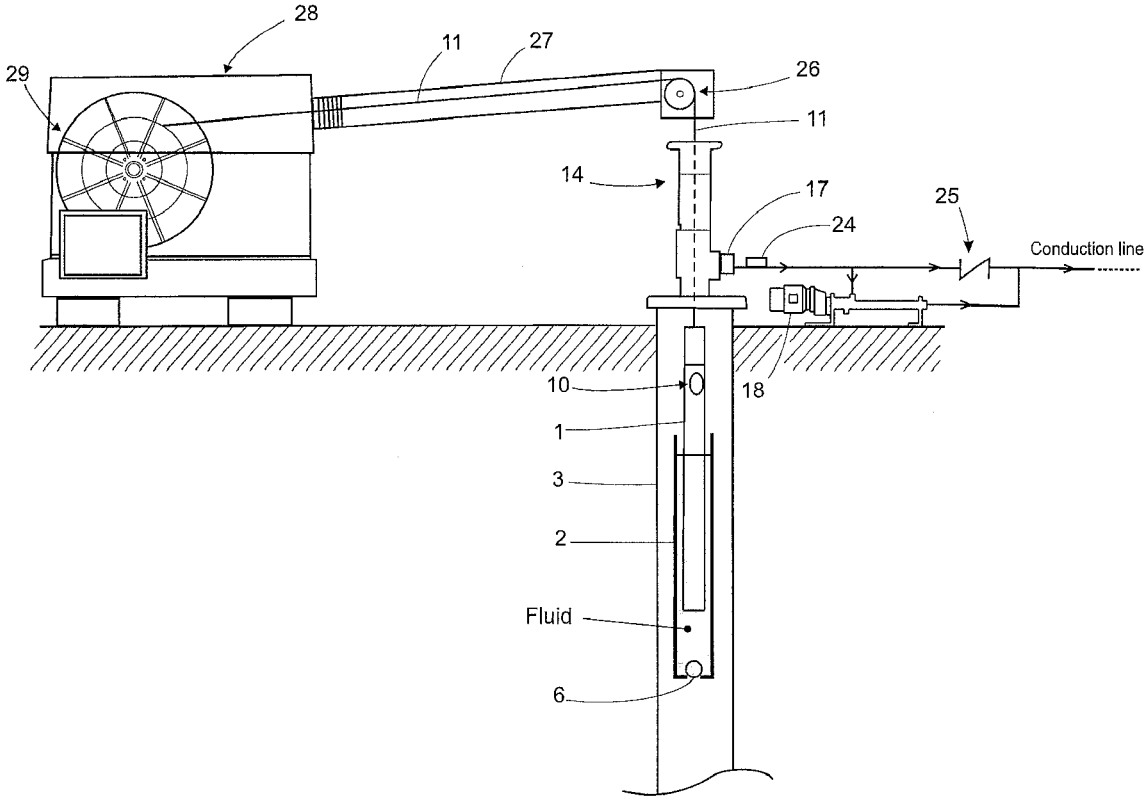
FIG. 2 is a schematic overall view showing a hydrocarbon lifting facility including the arrangement of the present invention.

FIG. 2 shows an exemplary embodiment of the present invention, in which the outlet duct 17 comprises a flow-rate control 24, which, by means of a one way check valve 25, is fluidly connected to the corresponding flow line, together with the outlet duct of pump 18, so that the produced gas will be driven to the storage facilities under its own pressure. The figure also shows that the pulling cable 11 goes through a pulley mechanism 26 and extends along a tube 27 to enter a motor driven equipment 28 where it is spooled on a drum 29.

Figure 3:
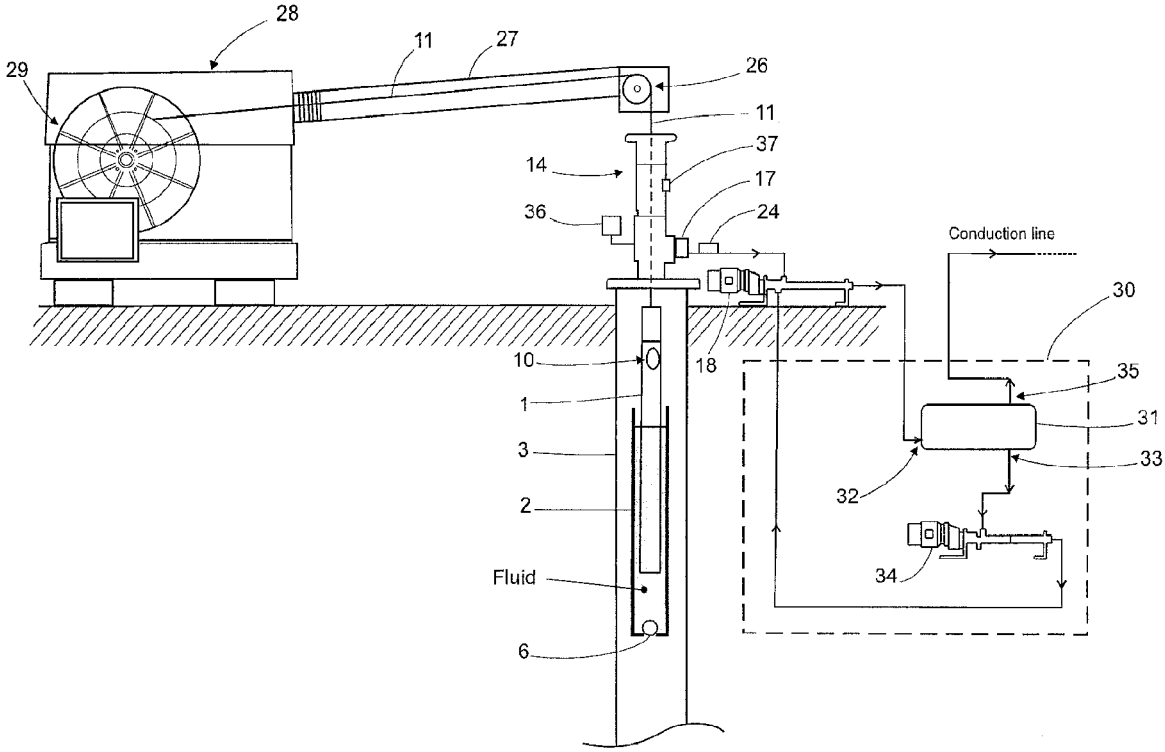
FIG. 3 is a schematic overall view showing a facility for lifting hydrocarbons comprising the arrangement of the present invention, where said facility includes a device for lowering gas pressure within the casing.

FIG. 3 shows a further embodiment of the present invention, which includes a device 30 designed to lower gas pressure within the well casing 3 whenever it is deemed convenient. Said device 30 comprises a storage tank 31 having an inlet 32 connected to the suction pump 18 outlet, a first outlet 33 connected to a screw pump 34, and a second outlet connected to the corresponding fluid transportation line. The outlet of the screw pump 34 is connected to an auxiliary inlet of the suction pump 18. In addition, in this exemplary embodiment the sealed chamber 16 of the wellhead 14 has an attached pressure switch 36 and a positioning sensor 37.

When the tube-hose assembly is in its discharge position as detected by sensor 37, the device 30 suctions the fluid to discharge hose 2. On the other hand, when the tube-hose assembly is not in position—during the upwards and downwards movements—if gas pressure is higher than desired, the pressure switch 36 actuates the device 30, allowing only gas to flow out.

What is claimed is:

1. An arrangement for the lifting of hydrocarbons placed within oil field wells, the arrangement having a wellhead assembly, a bailer device disposed along a well casing, a pulling cable extending up to a drum which forms part of the driving mechanism of the arrangement, wherein the arrangement extends inside the well casing, the arrangement comprising:

a movable fluid collecting hose; and a movable fluid suction tube extending along said fluid collecting hose, said fluid suction tube having an upper end and a lower end, the upper end of the suction tube projects beyond the upper end of the fluid collecting hose in which a fluid discharge opening is formed for discharging the fluid to be suctioned by a suction pump connected to the wellhead, the upper end of said suction tube being attached to the end of the pulling cable which drives the fluid collecting hose together with the fluid suction tube up and down;

wherein when the fluid collecting hose and the fluid moving tube are pulled up in the wellhead, the fluid discharge opening is placed between an upper ring and a lower ring positioned inside the wellhead, upper ring and a lower ring define a sealed chamber connected to the suction pump to suction the fluid from inside the fluid collecting hose.

2. The arrangement for the lifting of hydrocarbons according to claim 1, wherein said fluid collecting hose comprises an open upper end and a lower end which is closed by means of a one-way check valve, the one-way check valve opens into the hose to let the fluid flow into the one-way check valve, so that the fluid enters through the upper end of the hose.

3. The arrangement for the lifting of hydrocarbons according to claim 1, wherein the lower end of the suction tube is open and reaches the proximity of the lower end of the fluid collecting hose, the upper end of the suction tube is closed and said fluid discharge opening is laterally conformed in the upper end of said suction tube.

4. The arrangement for the lifting of hydrocarbons according to claim 1, wherein the cable attached to the upper end of the suction tube passes through a bushing through said upper ring and lower ring sealing rings during the descending travel of the hose tube assembly until it reaches the end of said travel, where said bushing is positioned as a guide for the cable.

5. The arrangement for the lifting of hydrocarbons according to claim 4, wherein said bushing forms part of a member having a lower section and an upper section, said lower section defining the bushing itself, while the upper member which has a larger diameter than the lower member, defines a guide for the displacement of the bushing, and, in addition, defines a sensor detecting the final position of the hose for its discharge, and an abutment on the upper sealing ring.

6. A method of raising a fluid in an oil field well having a well casing, the method comprising the steps of:

lowering a hollow fluid lifting assembly in the well casing into an accumulation of at least one fluid, the fluid lifting assembly having a first end and a second end;

selectively allowing the at least one fluid to enter the hollow fluid lifting assembly by way of a first opening in the first end;

raising the hollow fluid lifting assembly containing the at least one fluid from the accumulation of fluid in the well and sealingly coupling a second opening provided in the second end with a suction source; and applying a suction so as to evacuate the fluid contained in the hollow fluid lifting assembly;

the lifting assembly including:

a movable fluid collecting hose; and a movable fluid suction tube extending along said fluid collecting hose, said fluid suction tube having an upper end and a lower end, the upper end of the suction tube projects beyond the upper end of the fluid collecting hose in which a fluid discharge opening is formed for discharging the fluid to be suctioned by a suction pump connected to the wellhead, the upper end of said suction tube being attached to the end of the pulling cable which drives the fluid collecting hose together with the fluid suction tube up and down;

wherein when the fluid collecting hose and the fluid moving tube are pulled up in the wellhead, the fluid discharge opening is placed between an upper ring and a lower ring positioned inside the wellhead, upper ring and a lower ring define a sealed chamber connected to the suction pump to suction the fluid from inside the fluid collecting hose.

7. The method according to claim 6, wherein the first opening located in the fluid collecting hose is defined by a one-way valve constructed and arranged to selectively permit fluid flow only into the fluid collecting hose.

8. The method of claim 7, wherein sealingly coupling the second opening with a suction source comprises sealingly coupling a portion of the fluid suction tube provided with the second opening with an intake of a suction source.

9. The method of claim 8, further comprising enhancing an efficiency of fluid evacuation by permitting pressure from a gas present in the well to force the at least one fluid out of the hollow fluid lifting assembly in addition to a suction force from the suction source.

* * * * *